US008820037B2

(12) United States Patent
Ehrmann

(10) Patent No.: US 8,820,037 B2
(45) Date of Patent: Sep. 2, 2014

(54) THERMOFORMING PACKAGING MACHINE AND A METHOD FOR FILLING PACKAGING TROUGHS WITH PRODUCTS

(75) Inventor: Elmar Ehrmann, Bad Groenenbach (DE)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 184 days.

(21) Appl. No.: 13/194,019

(22) Filed: Jul. 29, 2011

(65) Prior Publication Data

US 2012/0023872 A1 Feb. 2, 2012

(30) Foreign Application Priority Data

Jul. 29, 2010 (EP) ..... 10007916

(51) Int. Cl.

| | |
|---|---|
| ***B65B 3/02*** | (2006.01) |
| ***B65B 47/00*** | (2006.01) |
| ***B65B 43/42*** | (2006.01) |
| ***B65B 35/24*** | (2006.01) |
| ***B65B 5/02*** | (2006.01) |

(52) U.S. Cl.

CPC ..... *B65B 47/00* (2013.01); *B65B 43/42* (2013.01); *B65B 35/24* (2013.01); *B65B 5/02* (2013.01)

USPC ..... 53/452; 53/453; 53/558; 53/559; 53/251

(58) Field of Classification Search

CPC ..... B29C 65/00; B29C 66/849; B29C 65/18

USPC ..... 53/452, 453, 558, 559, 250–252

See application file for complete search history.

(56) References Cited

U.S. PATENT DOCUMENTS

| | | | | | |
|---|---|---|---|---|---|
| 3,218,776 | A | * | 11/1965 | Cloud | 53/453 |
| 3,354,613 | A | * | 11/1967 | Anderson et al. | 53/251 |
| 3,775,932 | A | * | 12/1973 | Jeney | 53/433 |
| 3,815,322 | A | * | 6/1974 | Wyslotsky | 53/511 |
| 4,034,536 | A | * | 7/1977 | Mahaffy et al. | 53/433 |
| 4,265,070 | A | * | 5/1981 | Mainberger et al. | 53/433 |
| 5,201,163 | A | * | 4/1993 | Reil et al. | 53/410 |
| 6,282,866 | B1 | * | 9/2001 | Natterer et al. | 53/282 |
| 6,679,031 | B2 | * | 1/2004 | Tampieri | 53/453 |
| 7,104,035 | B2 | * | 9/2006 | Hahnel | 53/561 |

(Continued)

FOREIGN PATENT DOCUMENTS

| | | | |
|---|---|---|---|
| DE | 1 761 344 | A1 | 7/1971 |
| EP | 0 515 661 | B1 | 3/1994 |

(Continued)

OTHER PUBLICATIONS

European Search Report Dated Jul. 1, 2011, Applicant Multivac Sepp Haggenmueller GmbH & Co KG, Application No. 10007916.9-2308, 5 Pages.

*Primary Examiner* — Stephen F Gerrity
*Assistant Examiner* — Eyamindae Jallow
(74) *Attorney, Agent, or Firm* — Husch Blackwell LLP

(57) ABSTRACT

A thermoforming packaging machine according to the disclosure comprises a forming station for producing packaging troughs in a bottom foil, and a filler for filling the packaging troughs with products. The filler is arranged at a transition region for conveying the packaging troughs from a first transport plane to a second transport plane. A corresponding method for filling packaging troughs with products is also provided.

8 Claims, 2 Drawing Sheets

(56) References Cited

U.S. PATENT DOCUMENTS

| | | | | |
|---|---|---|---|---|
| 7,392,631 | B2 * | 7/2008 | Conti | 53/51 |
| 7,922,614 | B2 * | 4/2011 | Ruzic et al. | 474/206 |
| 8,181,432 | B2 * | 5/2012 | Bonneville et al. | 53/453 |
| 8,225,586 | B2 * | 7/2012 | Buchko et al. | 53/559 |
| 2002/0059783 | A1 * | 5/2002 | Kleinschmidt | 53/453 |
| 2003/0014945 | A1 * | 1/2003 | Danby | 53/452 |
| 2003/0136087 | A1 * | 7/2003 | Lehner et al. | 53/452 |
| 2004/0000128 | A1 * | 1/2004 | Di Lauretis et al. | 53/453 |
| 2004/0016205 | A1 * | 1/2004 | Douglas | 53/133.4 |
| 2004/0095714 | A1 * | 5/2004 | Chen | 361/683 |
| 2006/0207619 | A1 * | 9/2006 | Conti | 131/322 |
| 2008/0313998 | A1 * | 12/2008 | Ligon et al. | 53/455 |
| 2009/0272073 | A1 * | 11/2009 | Meyer | 53/141 |
| 2010/0095640 | A1 * | 4/2010 | Grimm | 53/453 |
| 2010/0287888 | A1 * | 11/2010 | Shackelford et al. | 53/453 |
| 2010/0287889 | A1 * | 11/2010 | Bonneville | 53/453 |
| 2012/0324833 | A1 * | 12/2012 | Koch et al. | 53/452 |

FOREIGN PATENT DOCUMENTS

| | | | |
|---|---|---|---|
| EP | 2253544 | A2 | 11/2010 |
| GB | 1106239 | | 3/1968 |
| GB | 1112066 | | 5/1968 |
| WO | 2005/108208 | A1 | 11/2005 |

* cited by examiner

THERMOFORMING PACKAGING MACHINE AND A METHOD FOR FILLING PACKAGING TROUGHS WITH PRODUCTS

CROSS-REFERENCE TO RELATED APPLICATIONS

This application claims foreign priority benefits under 35 U.S.C. §119(a)-(d) to European patent application number EP 10007916.9, filed Jul. 29, 2010, which is incorporated by reference in its entirety.

TECHNICAL FIELD

The disclosure relates to a thermoforming packaging machine, as well as to a method of filling packaging troughs with products by means of a filler.

BACKGROUND

A thermoforming packaging machine of the type in question is disclosed e.g. by EP 0 515 661 B1. In such thermoforming packaging machines a so-called bottom foil, which is a thermoformable plastic foil, is unwound from a foil roll. In a forming station the bottom foil is thermoformed so as to produce packaging troughs. These packaging troughs are advanced to a filling station where they are filled with products. Subsequently, the packaging troughs are transferred to an evacuating and sealing station in which the packaging troughs are closed with a top foil and, if necessary, previously evacuated and/or flushed with a replacement gas. Following this, the packaging troughs are normally separated from one another by longitudinal and cross separators.

The filling of the packaging troughs with products can be executed manually or in an automated fashion with a filler. For manual filling, the filling station and the filling line must be comparatively long so that a sufficient number of persons having a sufficient radius of movement can stay in this filling area and so that these persons have enough time for filling the packaging troughs. This, however, has the effect that the packaging machine inevitably becomes very long so that it not only takes up a lot of space when installed but is also comparatively expensive.

Automated filling of the packaging troughs with products by means of a filler has the advantage that the number of packaging troughs that can be filled per unit time is higher than in the case of manual filling. Frequently, conveyor belts are used for conveying the products (e.g. sliced food, such as sausage or cheese slices) into the packaging troughs.

However, even the use of an automated filler does not allow shorter dimensions of the thermoforming packaging machine. Since the bottom foil is always conveyed through the conventional thermoforming packaging machine in the same plane, the forming station used for thermoforming or at least the tool top of said forming station must project upwards beyond the conveying plane of the foil. Since especially sliced food must not fall perpendicularly into the packaging troughs and since filling takes place in the same transport direction as the transport of the bottom foil (so that, just as in the case of EP 0 515 661 B1, also juxtaposed packaging troughs are filled simultaneously), the conveyor belt of the filler must inevitably be inclined downwards. In order to prevent an excessively steep inclination and in order to avoid undesirable slipping of the products on the conveyor belt, the filling station must inevitably have very long dimensions also in the case of automated filling.

SUMMARY

It is an object of the present disclosure to improve, with the aid of means having the simplest possible structural design, a thermoforming packaging machine and a packaging process executed thereby such that a more compact structural design of the packaging machine can be accomplished.

A thermoforming packaging machine according to the present disclosure is characterized in that the packaging troughs and the bottom foil used for producing the latter are not—as has hitherto been the case—transported through the various work stations of the packaging machine in a constant transport plane, but that the packaging troughs are conveyed in a transition region from a first transport plane into a second transport plane which is different from the first one. Furthermore, the packaging machine is so conceived that the filler is arranged at this transition region. This has the advantage that, even if the filling line should be short, horizontal filling or filling at a very small angle relative to the horizontal will be possible, without the filler colliding with the tool top or with other components of the forming station. Hence, a very short, compact structural design of the thermoforming packaging machine can be achieved. This has additionally the effect that the packaging machine will become less expensive and that it will take up less space at the manufacturing plant.

Preferably, the first transport plane and the second transport plane of the packaging troughs are each horizontal planes. Especially as regards the second transport plane, this is advantageous insofar as the packaging troughs are filled when they reach this second transport plane. A horizontal orientation of the packaging troughs during filling hinders the product from dropping out of the packaging trough and facilitates thus the filling operation.

Against this background, it would also be imaginable that only the second transport plane is horizontal and that the first transport plane is arranged at an angle relative to the second transport plane—preferably such that the packaging troughs are transported in an ascending transport direction.

According to an expedient embodiment, the first transport plane extends below the second transport plane. In this case, the forming station can be configured such that it does not extend beyond the second transport plane in the upward direction. This allows the packaging troughs to be filled in the second transport plane by feeding the products horizontally.

Special advantages are achieved when the transition region is configured for reversing the transport direction of the bottom foil. This variant allows the forming station to be arranged in a second working plane below the plane of the filling station and possibly of the evacuating and sealing station. This makes the structural design of the packaging machine very compact.

In particular, it is imaginable that the transition region is configured for reversing the transport direction of the bottom foil by 180°, i.e. that a full reversal of the transport direction of the bottom foil is caused.

The filler preferably comprises a conveyor for conveying the products, said conveying of the products taking place substantially in the second transport plane. This has the advantage that an inclination of the conveyor that may lead to a displacement of the products will be avoided and that the products will not be deformed when they are filled into the packaging troughs, since their transport direction does not change. The conveyor may e.g. be a conveyor belt.

According to an expedient embodiment, the first transport plane and the second transport plane are spaced apart by a distance that is longer than one stroke of a tool member of the forming station. If this prerequisite is fulfilled, it is impossible that the filler collides with the forming station.

The present disclosure also relates to a method of filling packaging troughs with products by means of a filler. According to the present disclosure, the filling takes place at a transition region in which the packaging troughs are conveyed from a first transport plane to a second transport plane. This offers the above described advantages, in particular the advantage that the packaging machine executing the method will have a very compact structural design.

According to a preferred embodiment, the packaging troughs are thermoformed in a forming station before they are filled, i.e. the packaging machine used for executing the method is a thermoforming packaging machine. Such a thermoforming packaging machine has the advantage that the packaging troughs have not yet been separated from one another during the filling process, but are fixed to one another due to the fact that they are formed in common in a bottom foil. The packaging troughs can thus more easily be deflected during transport so as to convey them from a first transport plane into a second transport plane. To this end, a lateral clamp chain may be provided, which takes hold of the bottom foil and conveys it. However, also a variant in the case of which a tray sealer is used, instead of a thermoforming packaging machine, would be imaginable.

According to a preferred embodiment, the transport direction of the packaging troughs is changed by 180° in the transition region. It is thus possible to arrange the forming station below the filling station and the filler, respectively, so as to achieve a very compact structural design.

It may possibly be advantageous when the packaging troughs have a curved shape when they are being filled. This can be caused by the circumstance that the filling takes place before the packaging troughs have fully reached the second transport plane. The curved shape of the packaging troughs can facilitate insertion of the products in the packaging trough in the horizontal direction.

It is particularly advantageous when the filler conveys the products into the respective packaging troughs in the horizontal direction. In this case, the products will be neither deflected nor bent during the filling process. Such deflection or bending may otherwise cause an undesirable deformation of the products.

Preferably, the horizontal conveying of the products in the filler takes place substantially in the second transport plane.

A conveyor of the filler, e.g. a conveyor belt, and a transport of the packaging troughs are preferably synchronized with one another. This will be of advantage especially in the case of a cyclic, intermittent operation of the packaging machine used for executing the method, so as to guarantee that the products will only be fed when empty packaging troughs are available.

In the following, advantageous embodiments of the disclosure will be explained in more detail with reference to the below drawings.

DETAILED DESCRIPTION

Figure 1:
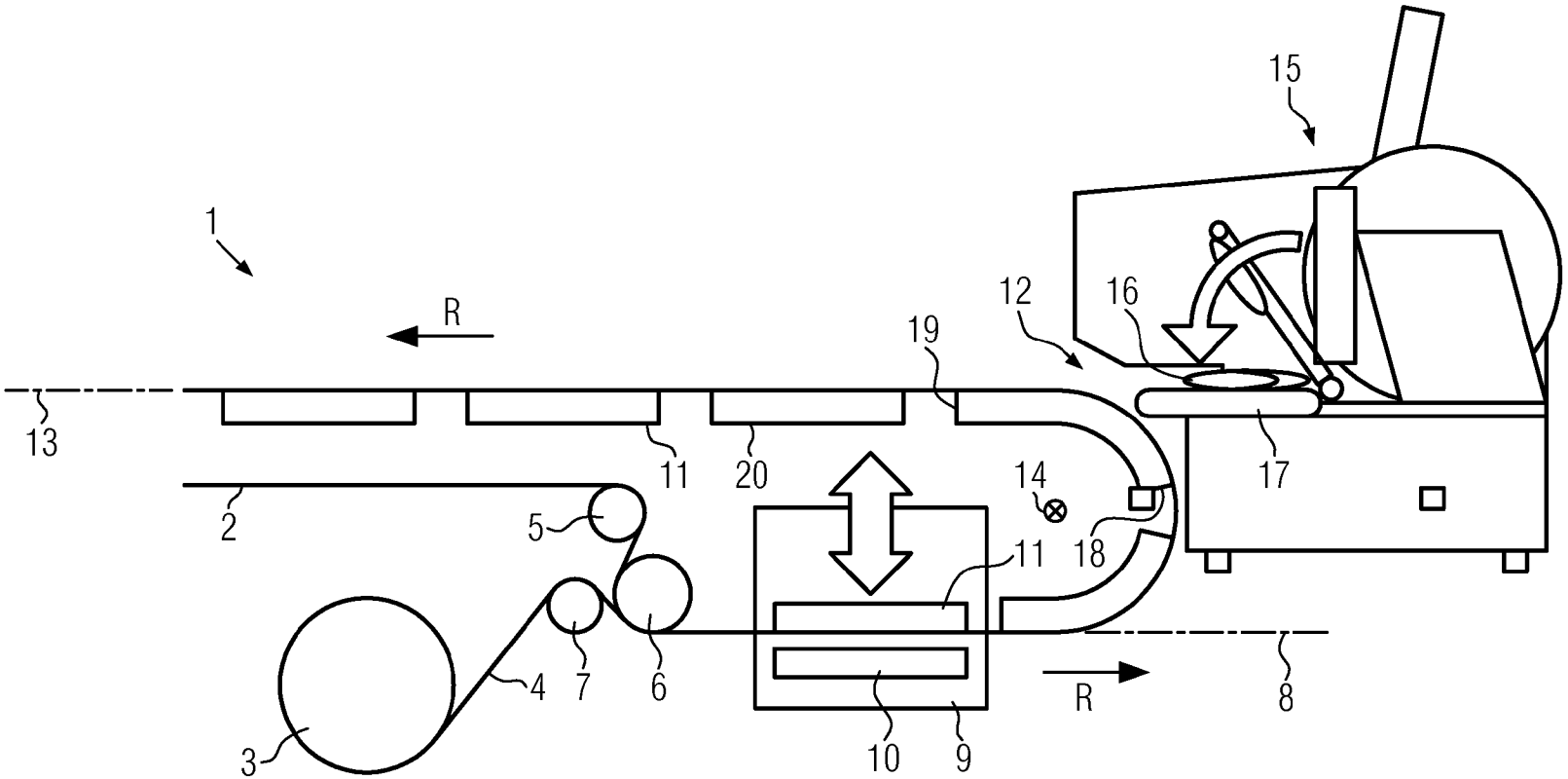
FIG. 1 is a schematic representation of a first embodiment of a packaging machine according to the present disclosure.

Identical components are provided with identical reference numerals throughout the figures.

FIG. 1 shows in a schematic representation a first embodiment of a packaging machine 1 according to the present disclosure. For the sake of clarity, only the packaging machine components which are most important to the disclosure are shown.

The packaging machine 1 is a thermoforming packaging machine. It is equipped with a conveyor, such as an endless circulating transport chain 2, that is able to take hold of a bottom foil 4, which is unwound from a foil roll 3, on both sides thereof and to tension it, if necessary, transversely to the transport direction. The bottom foil 4 is a thermoformable plastic foil, e.g. a PA/PE composite foil.

Deflection pulleys 5, 6 transfer the transport chain 2 and the bottom foil 4, which is conducted to the transport chain 2 via a further deflection pulley 7 and which is laterally seized by the transport chain 2, to a first transport plane 8 that is horizontal in the present embodiment. In this first transport plane 8 the bottom foil 4 is conducted into a forming station 9 when the transport chain 2 is advanced intermittently. After suitable heating of the bottom foil, which is executed according to requirements, a forming tool 10, e.g. a male die part or a vacuum unit, ensures that packaging troughs 11 are formed from the bottom foil 4 in the forming station 9 by sectionwise thermoforming.

When the transport chain 2 is advanced still further, the bottom foil 4 and together therewith the packaging troughs 11 arrive at a transition region 12 where the packaging troughs 11 are transported from the first transport plane 8 into a second transport plane 13. Also this second transport plane 13 is horizontal and it extends on a higher level than the first transport plane 8. In the transition region 12, the transport direction R of the bottom foil 4 and of the packaging troughs 11 is changed by 180° in that a chain guide deflects the transport chain 2 about a virtual, horizontal axis 14.

One component of the thermoforming packaging machine 1 according to the present disclosure is a filler 15 for filling the packaging troughs 11 with products 16. The filler 15 may be a cutter and/or a depositor. The products 16 may be foodstuffs, e.g. sausage or cheese, which are sliced. The filler 15 is provided with a horizontal conveyor 17, e.g. a conveyor belt, by means of which the products 16 are, in portions, conveyed or introduced into the packaging troughs 11.

FIG. 1 shows that the conveying of the products 16 on the horizontal conveyor 17 also takes place in the horizontal second transport plane 13. Due to the curvature of the transport chain 2 in the transition region 12, also the packaging troughs 11 are curved during the filling operation. The trailing end 18 of the packaging troughs 11 is there so to speak bent downwards relative to the second transport plane 13, since this trailing end 18 has not yet reached the second transport plane 13. This trailing end 18 will therefore not interfere with the filling of the packaging troughs 11 when the products 16 are conveyed into the packaging troughs 11 in the horizontal direction. If necessary, the leading end 19 of the packaging troughs may be used as a stop for the products 16 so as to prevent said products 16 from being conveyed beyond the packaging troughs 11 to be filled.

In FIG. 1, the whole forming station 9 is located below the second transport plane 13, in particular below the bottom 20 of the packaging troughs 11 located in the second transport plane 13. It is thus possible to arrange the forming station 9 fully below the filling area of the packaging machine 1 and to achieve a very compact structural design of the packaging machine 1 in this way.

Figure 2:
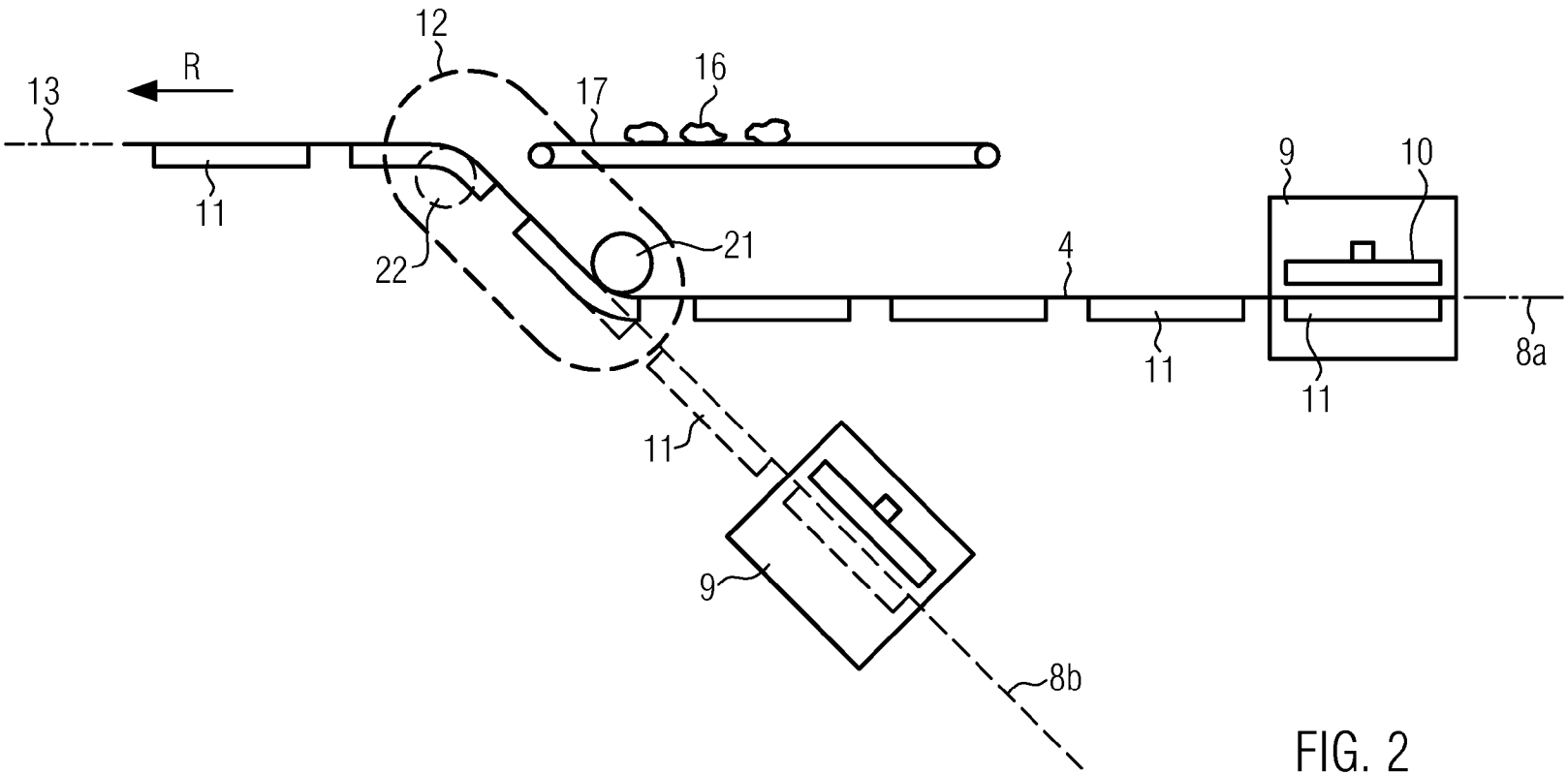
FIG. 2 is a schematic representation of two further embodiments of a packaging machine according to the present disclosure.

FIG. 2 shows two further variants of embodiments of the packaging machine 1. In the case of a first variant, depicted by solid lines, the first transport plane 8*a*, in which the packaging troughs 11 are thermoformed in the forming station 9, extends again horizontally and below the second transport plane 13. However, in contrast to the first embodiment, the transport direction R of the packaging troughs 11 is not changed by 180° in the transition region 12. Instead, two deflection pulleys 21, 22 are provided so as to deflect the transport chain 2 and the bottom foil 4 seized by the latter by approx. 50° each and so as to transfer them with an approximately S-shaped movement from the first transport plane 8*a* to the second transport plane 13. In said second transport plane 13, a conveyor belt 17 of the filler 15 places the products 16 into the packaging troughs 11 to be filled. Deviating from the representation in FIG. 2, the forming station 9 may also be located fully below the conveyor 17 so as to accomplish an even more compact structural design.

According to a second variant, depicted by broken lines, the first transport plane 8*b*, in which the packaging troughs 11 are thermoformed in the forming station 9, is not arranged horizontally but at an angle relative to the second transport plane 13. Hence, a single deflection pulley 22 suffices to transfer the transport chain 2 and the bottom foil 4 conducted thereby from the first transport plane 8*b* to the second transport plane 13. The arrangement of the first transport plane 8*b* at an angle relative to the second transport plane 13 enlarges the vertical distance between the forming station 9 and the horizontal conveyor 17 of the filler 15. It is thus possible to construct a packaging machine 1 which, although it may have a greater height, is even more compact in its longitudinal direction.

When the method according to the present disclosure used for filling packaging troughs is being executed, i.e. when the packaging machine 1 according to the present disclosure is in operation, the packaging troughs 11 are filled in the transition region 12 in which the packaging troughs 11 are conveyed from the first transport plane 8, 8*a*, 8*b* to the second transport plane 13. In both FIGS. 1, 2 it can be seen that the packaging troughs 11 have a curved shape at the moment at which they are filled with the products 16. It would be imaginable to thermoform folds or predetermined knuckle lines into the packaging troughs 11 already during thermoforming of the latter so as to facilitate a curvature of the packaging troughs 11. The drive of the transport chain 2 of the packaging machine 1 is preferably synchronized with the drive of the horizontal conveyor 17 of the filler 15, so that further products 16 will be conducted to the packaging troughs 11 only if empty packaging troughs 11 are available in the filling region.

Starting from the embodiments shown, the packaging machine 1 according to the present disclosure and the method according to the present disclosure can be modified in many ways.

While embodiments of the disclosure have been illustrated and described, it is not intended that these embodiments illustrate and describe all possible forms of the disclosure. Rather, the words used in the specification are words of description rather than limitation, and it is understood that various changes may be made without departing from the spirit and scope of the disclosure.

What is claimed is:

1. A thermoforming packaging machine comprising:

a forming station for producing packaging troughs in a bottom foil;

a lateral clamping chain which grips and transports the bottom foil;

a transition region for conveying the packaging troughs from a first transport plane to a second transport plane, wherein the first transport plane is located below the second transport plane and the transition region begins when the bottom foil leaves the first transport plane and ends when the bottom foil enters the second transport plane, the transition region being configured for reversing transport direction of the bottom foil by around one-hundred eighty (180) degrees;

wherein the bottom foil is conveyed in the first transport plane into the forming station during intermittent infeed of the lateral clamping chain; and a filling device for filling the packaging troughs with a product, the filling device comprising a conveyor for conveying a product substantially in the second transport plane, and wherein the packaging trough is in communicating relationship with the filling device for receiving a product therein as the packaging trough is at least partially located in the transition region.

2. A thermoforming packaging machine according to claim 1 wherein the first transport plane and the second transport plane are each a horizontal plane.

3. A thermoforming packaging machine according to claim 1 wherein the first transport plane and the second transport plane are spaced apart by a distance that is larger than one stroke of a tool member of the forming station.

4. A method of filling packaging troughs with products, the method comprising:

gripping and transporting a bottom foil in a transport direction with a lateral clamping chain;

advancing the bottom foil on a first transport plane into a forming station by the intermittent infeed of the lateral clamping chain;

thermoforming packaging troughs in the bottom foil in the forming station prior to filling;

changing the transport direction of the bottom foil by around one-hundred eighty (180) degrees in a transition region, wherein the packaging troughs are conveyed from the first transport plane to a second transport plane in the transition region and wherein the transition region starts when the bottom foil leaves the first transport plane and ends when the bottom foil enters the second transport plane;

conveying a product in a filling device substantially in the second transport plane, wherein the filling device is arranged at the transition region and wherein the packaging troughs come into a communicating relationship with the filling device for receiving a product therein; and filling the packaging troughs with a conveyed product using the filling device when the packaging trough is at least partially located in the transition region.

5. A method according to claim 4 wherein the packaging troughs each have a curved shape during the filling step.

6. A method according to claim 4 wherein the filling device conveys the products in a horizontal direction into the respective packaging troughs.

7. A method according to claim 4 wherein a conveyor of the filling device and the transport of the packaging troughs are synchronized with one another.

8. A method according to claim 4 further comprising cutting the products into portions in the filling device.

* * * * *